United States Patent [19]

Larson

[11] 4,378,421

[45] Mar. 29, 1983

[54] CLEANING METHOD AND APPARATUS FOR AN ELECTROGRAPHIC SYSTEM

[75] Inventor: Wallace B. Larson, San Jose, Calif.

[73] Assignee: International Business Machines Corp., Armonk, N.Y.

[21] Appl. No.: 219,074

[22] Filed: Dec. 22, 1980

[51] Int. Cl.[3] ..... G03G 15/08; G03G 21/00

[52] U.S. Cl. ..... 430/121; 118/652; 118/688; 118/697; 118/699; 355/15; 430/125

[58] Field of Search ..... 118/652, 697, 699, 688; 355/14 CH, 15; 430/125, 121

[56] References Cited

U.S. PATENT DOCUMENTS

| | | | |
|---|---|---|---|
| 3,918,968 | 11/1975 | Kukla et al. . | |
| 3,944,354 | 3/1976 | Benwood et al. | 355/15 X |
| 4,167,325 | 9/1979 | Plumadore | 355/14 CH |
| 4,201,465 | 5/1980 | Oyama et al. | 118/652 X |

*Primary Examiner*—Evan K. Lawrence

*Attorney, Agent, or Firm*—Henry E. Otto, Jr.

[57] ABSTRACT

A method and apparatus for cleaning residual toner from the surface of an imaging member in an electrographic imaging system which uses carrier means to transport toner by triboelectric forces to develop an electrostatic image on the imaging member. The preclean corona current is adjusted periodically during the lifetime of the carrier as necessary substantially to neutralize the charge on residual toner so that it may readily be removed by a rotating cleaning brush having substantially no charge thereon. Adjustment is in response to a periodically sensed aging characteristic, the charge density of the toner, such as at successive preselected operating time intervals representing increments of carrier useful lifetime. In this manner, cleaning efficiency is maintained.

8 Claims, 3 Drawing Figures

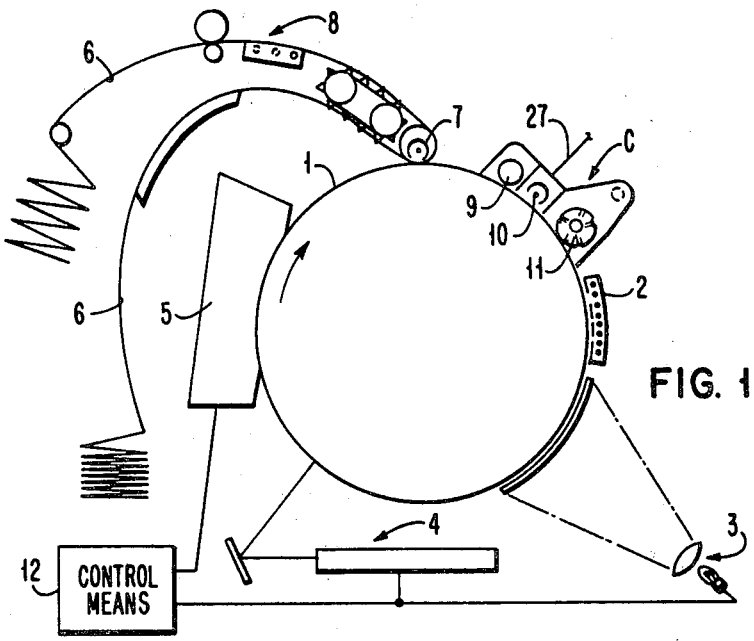
FIG. 1
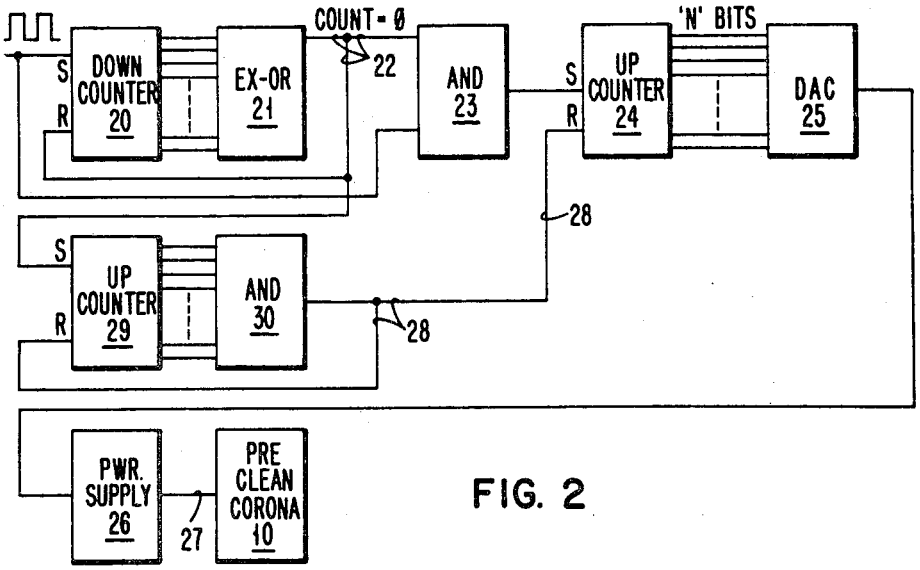
FIG. 2
FIG. 3
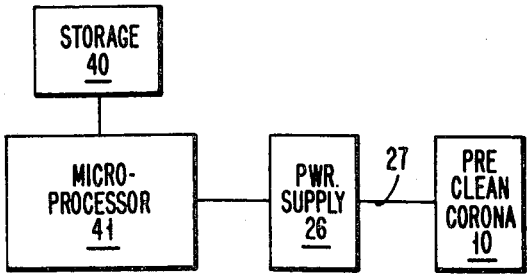

CLEANING METHOD AND APPARATUS FOR AN ELECTROGRAPHIC SYSTEM

DESCRIPTION

1. Technical Field

This invention relates to a method and apparatus for cleaning residual toner from the surface of an imaging member in an electrographic imaging system employing a toner-coated carrier in the development process.

In apparatus of this type, when the carrier is new, the toner is highly charged negatively. For effective removal of residual toner, the toner must be appropriately discharged or the efficiency of the cleaning brush will be poor. As the carrier ages, the surface of the carrier changes due to wear or becomes coated with fused-on toner, and the active surface area of the toner will be decreased. This will cause the toner to become charged less negatively. As a result of the toner being undercharged, efficiency of the cleaning brush will also be poor. Thus, the cleaning efficiency is greatly affected by the charge on the toner.

2. Prior Art

U.S. Pat. No. 4,123,154 discloses a brush cleaning apparatus wherein the cleaning brush is subjected to corona emissions from one or more corona generators. One corona generating unit applies a neutralizing corona prior to engagement of the brush with the photoconductive surface, and another corona generating unit applies a bias charging corona to the cleaning brush after the brush engages the photoconductive surface. However, no means are disclosed for automatically varying the charge on one or more of these corona generating units as the carrier ages.

U.S. Pat. No. 4,133,610 proposes a method for establishing optimum levels of pre-clean corona charge density. This method involves the steps of setting the transfer corona charge density to a desired level in order to obtain quality copy, and then adjusting the pre-clean corona charge density to an optimum value nearly equal to the transfer corona charge density. The adjustment appears to be effected manually. No means are disclosed automatically to vary the charge on the pre-clean corona as necessary to maintain good print quality as the carrier ages.

The IBM 3800 Printing Subsystem uses a triboelectric brush charging method and apparatus employing a charged cleaning brush and a flicker plate. A power supply provides a constant pre-clean corona current to the brush to control the charge on the toner. There is no suggestion of dispensing with the flicker plate and using an uncharged cleaning brush, and neutralizing the charge on the toner as the carrier ages by adjusting the magnitude and sign of the pre-clean corona current.

In view of the considerable variation in cleaning efficiency resulting from changes in charge on the toner as the carrier ages, there is a need, in an electrographic system of the type described, for a method and apparatus for maintaining the cleaning efficiency of the cleaner brush substantially constant as the carrier ages.

SUMMARY OF THE INVENTION

Toward this end and according to the invention, there is provided an improved apparatus for cleaning residual toner from an electrographic imaging system using carrier means to transport toner by triboelectric forces to develop an electrostatic image on an imaging member. This apparatus comprises brush cleaning means mounted for movement in a cyclic path contacting the imaging surface to clean residual toner from said surface, pre-clean corona means mounted adjacent said imaging surface, and means for energizing said pre-clean corona means to produce a charge on said imaging surface. The improvement is characterized by including means to sense a preselected aging characteristic of the carrier means, and means to adjust the energizing means for the pre-clean corona in a predetermined manner in response to the sensed aging characteristic of the carrier means to maintain substantially constant cleaning characteristics over the lifetime of the brush cleaning means.

BRIEF DESCRIPTION OF DRAWINGS

The invention will be described by way of example with reference to the accompanying drawings, in which:

FIG. 1 is a schematic view of an electrographic apparatus embodying the present invention;

FIG. 2 is a block diagram showing details of a brush cleaning apparatus partially shown in FIG. 1 and constructed according to one embodiment of the invention; and FIG. 3 is a block diagram showing details of a cleaning apparatus partially shown in FIG. 1 and constructed according to another embodiment of the invention.

DETAILED DESCRIPTION

An electrographic apparatus embodying the invention is shown in FIG. 1. As illustrated, this apparatus is of the electrophotographic type comprising a rotatable drum 1, the outer periphery of which is coated with a suitable photoconductive material. As the drum rotates in the direction of the arrow, the photoconductive surface is uniformly charged to a predetermined polarity by a corona discharge device 2. The charged surface is then exposed to a light image at a forms flash station 3 and/or exposure station 4 to produce a latent electrostatic image. This latent electrostatic image is developed by a suitable development unit 5 in which the carrier is charged triboelectrically by a tumbling action and the toner is attracted to the carrier, and the toner-carrier mixture is cascaded across the electrostatic image on the photoconductive surface, in conventional manner. The toner has a charge whereby it is attracted to the photoconductive surface of drum 1 to render the latent image visible. The image is then transferred, as for example to a continuous form sheet 6, with the aid of a transfer corona unit 7. This corona unit 7 sprays ions on the back side of sheet 6 of a polarity opposite that of the toner, thereby causing the toner image from drum 1 to be attracted to the sheet. After corona transfer, sheet 6 is separated from drum 1 and fed past a fusing station 8 at which the toner is fused and permanently fixed to the sheet.

Since complete transfer of the image toner is usually not accomplished, some residual toner will remain on the photoconductive surface of drum 1 after the transfer operation. A cleaning station C is therefore provided at which the photoconductive surface is exposed successively to an erase lamp 9, a pre-clean corona unit 10 and a rotating cleaning brush 11. Erase lamp 9 discharges the photoconductive surface.

According to features of the invention, the magnitude and sign of the current supplied to pre-clean corona unit 10 is adjusted as the carrier ages as necessary substantially to neutralize the charge on the residual toner so that it may readily be removed by sweeping action of the rotating cleaning brush 11. Note that there is no flicker plate or wedge and hence no triboelectric charging of the cleaning brush 11 occurs, with the result that the brush is uncharged. This completes a cycle of operation for producing the desired image. The process is then repeated as the photoconductive surface on drum 1 once again is charged as it passes beneath corona discharge device 2.

Control means 12, which forms no part of the present invention, operates in conventional manner to supply electrical control signals to coordinate the operation of all components of the electrophotographic apparatus. The position of the image on drum 1 is coordinated so that the proper operations transpire at the various stations around the drum at the appropriate time. Control means 12 may also provide temporary storage for image data supplied to exposure station 4, if desired.

In an electrophotographic apparatus of the type just described, the charge on the toner is proportional to the charge on the carrier; and the charge on the carrier will progressively reduce as the active surface area of the carrier is decreased due to wear and/or contamination with fused-on toner.

According to the embodiment of the invention illustrated in FIG. 2, a series of clock pulses from a suitable source (not shown) are supplied to a down counter 20 that is initially conditioned to decrement from a predetermined number. When counter 20 decrements to $\phi$, an EXCLUSIVE OR gate 21 will be enabled and provide a pulse in line 22 to reset counter 20 to said predetermined number. The clock pulse and pulse in line 22 will enable an AND gate 23 to step an up counter 24. When the count in counter 24 increments to a preselected number, a pulse will be transmitted to a digital-to-analog converter (DAC) 25 to effect an incremental adjustment of a power supply 26 that controls the magnitude and sign of the current supplied by a line 27 to pre-clean corona unit 10. The sign of the current supplied to pre-clean corona unit 10 will also depend upon the polarity of the toner being used.

The predetermined number is selected by reference to curves that show the variation in charge density (Q/m) of the toner as the carrier ages. An apparatus and method for measuring charge density are described in U.S. Pat. No. 3,918,968, assigned to the assignee of the present invention. Thus, if it is determined that a significant change in the charge density of the toner occurs every 100 minutes and useful carrier life is 10,000 minutes, counter 20 could initially be set for 360,000, so that with 60 Hz clock pulses, power supply 26 would be incremented every 100 minutes to provide a change in pre-clean corona current of a magnitude dependent on the preselected number that resets counter 24. This incrementing will continue until a pulse is provided in line 28 at the end of the preselected time interval (here assumed as 10,000 minutes) that corresponds to useful carrier life. The pulse to line 28 will reset the up counter 24 to recondition the power supply 26 to provide appropriate initial current to the pre-clean corona unit 10 for use with new carrier.

Thus, assuming that the electrophotographic apparatus illustrated employs a negatively charged toner, the toner will be highly charged negatively when the carrier is new. Hence, power supply 26 will initially be conditioned to supply a high positive pre-clean corona current to insure complete discharge of the toner. As the active surface area of the carrier decreases due to wear and contamination with fused-on toner, the toner progressively will become charged less negatively. During this progressive change, the magnitude of the pre-clean corona current will automatically be changed progressively. As the carrier approaches the end of its useful life, a negative pre-clean corona current will actually be applied to the toner to increase its charge as necessary to maintain the cleaning efficiency of cleaning brush 11.

As illustrated, the end of carrier life pulse to line 28 is provided by a timing means comprising an up counter 29 and an AND gate 30. Up counter 29 is incremented every time line 22 is pulsed (i.e., as assumed, every 100 minutes) until the count reaches a predetermined number (here assumed as 100) corresponding to a useful carrier life of $100 \times 100$ or 10,000 minutes; whereupon AND gate 30 will be enabled and provide the pulse in line 28 for resetting up counters 24 and 29. Alternatively, in apparatus where a timer is employed to signal the end of carrier life, the signal in line 28 may be provided by such timer.

According to the embodiment of the invention illustrated in FIG. 3, the charge density, Q/m, of the particular toner used is measured periodically during the lifetime of the particular carrier in order to provide a curve representing the decline in charge density as the carrier ages. This curve is then assumed as indicative of the aging characteristic of that toner-carrier combination. The magnitude and polarity of the pre-clean corona current necessary to neutralize the toner at a plurality of values of charge density is then determined to provide a curve representing changes in neutralizing pre-clean corona current over carrier life.

In a storage table 40 are stored the absolute values of voltage that should be applied to the power supply 26 at preselected time intervals as necessary to effect neutralization of the toner as the carrier ages. A microprocessor 41, by look up in table 40, operates at said preselected time intervals to adjust the voltage to power supply 26 as required to control the toner-neutralizing current supplied by pre-clean corona unit 10.

It will be understood that, if preferred, the apparatus may be provided with means (not shown) to sense the Q/m of the toner automatically and periodically, and through an appropriate algorithm cause microprocessor 41 to control the voltage to power supply 26, without need for the table 40.

It is to be noted that in the foregoing embodiments and variations thereof, means (not shown) are provided operative in conventional manner to monitor toner concentration and add toner as necessary to maintain toner concentration constant at a predetermined value. All Q/m values are determined with the toner at said predetermined value.

While the invention has been particularly shown and described with reference to the preferred embodiments thereof, it will be understood by those skilled in the art that the foregoing and other changes in form and details may be made therein without departing from the spirit, scope and teaching of the invention. Accordingly, the method and apparatus herein disclosed are to be considered merely as illustrative, and the invention is to be limited only as specified in the claims.

I claim:

1. Apparatus for removing residual toner from the surface of an imaging member in an electrographic imaging system in which periodically replenished toner is transported by a carrier by triboelectric forces to develop an electrostatic image on a moving imaging surface, said apparatus comprising:

brush means mounted for movement in a closed path and contacting said imaging surface to clean residual toner from said surface;

pre-clean corona means mounted adjacent said imaging surface upstream of said brush means for producing a charge on said residual toner;

means for sensing the charge density of the toner as a characteristic indicative of the aging of the carrier; and means operatively responsive to said charge density, as sensed, to vary the current to the pre-clean corona means as necessary to produce a charge substantially neutralizing the charge on the residual toner prior to contact by said brush means to maintain cleaning efficiency substantially constant as the carrier ages.

2. Apparatus according to claim 1, wherein there is zero charge on the brush means.

3. Apparatus according to claim 1, wherein said sensing means includes means operated at preselected time intervals during operation of the apparatus to cause said charge-density responsive means to operatively vary the current to the pre-clean corona means incrementally during aging of the carrier to compensate for changes in charge density of the toner as the active surface area of the carrier decreases due to wear and/or contamination.

4. Apparatus according to claim 1, wherein said sensing means includes means to sense the charge density of the toner upstream of the brush means.

5. Cleaning apparatus for the surface of an imaging element is an electrophotographic imaging system which employs toner periodically replenished and transported by a carrier by triboelectric forces to develop an electrostatic image on an imaging surface of a re-usable photoconductive imaging element movable in a closed path, said cleaning apparatus including a pre-clean corona unit positioned adjacent said path to neutralize electrostatic charges on residual toner on the imaging element as it passes the corona unit, a power supply for the corona unit and a rotary cleaning brush positioned to contact the imaging element to remove the neutralized toner therefrom, characterized by means for sensing the charge density of the toner as a characteristic indicative of the aging of the carrier, means coupled to the power supply to vary the magnitude and sign of the current to the pre-clean corona unit in accordance with changes in charge density of the toner as sensed by said sensing means during aging of the carrier as necessary to substantially neutralize the electrostatic charge on the toner prior to contact by the brush to maintain substantially constant cleaning efficiency as the carrier ages.

6. A method of cleaning residual toner from from the surface of an imaging member in an electrographic imaging system of the type which uses carrier means to transport toner by triboelectric forces to develop an electrostatic image on the imaging member, said method comprising the steps of:

sensing the charge density of the toner repeatedly during the lifetime of the carrier means, said charge density being a characteristic indicative of the aging of the carrier means; and adjusting the current to a pre-clean corona unit adjacent said imaging surface in response to the sensed charge density as necessary to cause said unit substantially to neutralize any electrostatic charge on the residual toner prior to contact by a cleaning brush on which there is substantially no charge, thereby to maintain cleaning efficiency substantially constant as the carrier ages.

7. The method according to claim 6, characterized in that during the adjusting step the current is adjusted periodically corresponding to successive fractional increments of the useful lifetime of the carrier means.

8. The method according to claim 7, wherein said current adjusting is carried out periodically by means of a microprocessor periodically adjusting a power supply connected to said pre-clean corona unit, said microprocessor operating through periodic table look up in a storage table containing data on required adjustment of said power supply as a function of time.

* * * * *